US006564779B2

(12) United States Patent
Sugimoto et al.

(10) Patent No.: US 6,564,779 B2
(45) Date of Patent: May 20, 2003

(54) EVAPORATED FUEL TREATMENT DEVICE

(75) Inventors: Takashi Sugimoto, Okazaki (JP); Takuya Nakagawa, Okazaki (JP)

(73) Assignee: Futaba Industrial Co., Ltd., Okazaki (JP)

( * ) Notice: Subject to any disclaimer, the term of this patent is extended or adjusted under 35 U.S.C. 154(b) by 0 days.

(21) Appl. No.: 09/792,943

(22) Filed: Feb. 26, 2001

(65) Prior Publication Data

US 2001/0017129 A1 Aug. 30, 2001

(30) Foreign Application Priority Data

Feb. 28, 2000 (JP) ..... 2000-051540

(51) Int. Cl.[7] ..... F02M 25/08
(52) U.S. Cl. ..... 123/520
(58) Field of Search ..... 123/518, 519, 123/520, 698

(56) References Cited

U.S. PATENT DOCUMENTS 4,841,940 A * 6/1989 Uranishi et al. ..... 123/694
5,647,332 A * 7/1997 Hyodo et al. ..... 123/519

FOREIGN PATENT DOCUMENTS

JP 5-71430 * 3/1993 ..... 123/519
JP 6-81722 * 3/1994 ..... 123/519

* cited by examiner

*Primary Examiner*—Tony M. Argenbright
(74) *Attorney, Agent, or Firm*—Davis & Bujold, P.L.L.C.

(57) ABSTRACT

An evaporated fuel treatment device in which performance of a canister can be improved, with the result that efficiency in treatment of evaporated fuel can be enhanced. In the evaporated fuel treatment device, a purge control valve, conventionally disposed on a purge passage, is removed, such that the canister is directly subject to a negative pressure generated on the side of an inlet pipe at the time of starting of an engine. Consequently, a great attraction force acts on the evaporated fuel adsorbed within the canister. Also, by restricting a flow of air introduced into the canister by means of a flow control valve, the negative pressure applied to the canister can further be increased. As a result, in the evaporated fuel treatment device of the invention, the amount of the evaporated fuel which can be desorbed from the canister is larger than that of a conventional device.

3 Claims, 3 Drawing Sheets

EVAPORATED FUEL TREATMENT DEVICE

FIELD OF THE INVENTION

The present invention relates to an evaporated fuel treatment device in which a canister can be improved in its capability of interiorly adsorbing evaporated fuel generated in a fuel tank.

BACKGROUND OF THE INVENTION

Conventionally, a vehicle mounted with an engine, for which a highly volatile fuel (for example, gasoline or the like) is utilized, is equipped with an evaporated fuel treatment device to prevent emission into the atmosphere of evaporated fuel generated in a fuel tank.

Such an evaporated fuel treatment device, as shown in FIGS. 3A and 3B, comprises a canister 110 within which evaporated fuel generated in a fuel tank 120 is temporarily adsorbed and a purge control valve 150 which is provided in the middle of a purge passage 145 connecting the canister 110 and an inlet pipe 102 and which is opened and closed according to the operational status of an engine 101. When the purge control valve 150 is opened, the evaporated fuel adsorbed within the canister 110 is purged (introduced) into the inlet pipe 102, together with air introduced by a negative pressure generated on the side of the inlet pipe 102, to be led into cylinders. At this time, a flow of an air-fuel mixture composed of the evaporated fuel and the air to be delivered to the inlet pipe 102 is adjusted by controlling opening and closing of the purge control valve 150. In this way, combustion is realized at a desired air-fuel ratio in the engine.

In the aforementioned manner, transpiration into the atmosphere of the evaporated fuel generated in the fuel tank 120 is prevented, and fuel in the fuel tank 120 is thus consumed without being wasted.

The evaporated fuel adsorbed within the canister 110 is desorbed in such a manner that it is attracted by the negative pressure generated on the side of the inlet pipe 102 when the engine 101 is started. And then, the evaporated fuel desorbed from the canister 110 is delivered to the inlet pipe 102, together with the air introduced into the canister 110, through the purge passage 145.

However, in the aforementioned conventional structure, the negative pressure generated on the side of the inlet pipe 102 is suppressed by the purge control valve 150 provided on the purge passage 145. Also, the purge control valve 150 can be a ventilation resistance for the air-fuel mixture containing the evaporated fuel desorbed from the canister 110. Accordingly, there is a certain limitation in desorption efficiency for the evaporated fuel adsorbed within the canister 110. On the other hand, since the amount of the evaporated fuel subsequently adsorbed within the canister 110 corresponds to the amount of the evaporated fuel desorbed from the canister 110 at this time, the desorption efficiency in the canister 110 also influences adsorption efficiency therein. Consequently, the canister 110 in the aforementioned conventional structure has a certain limitation in its capability of treating the evaporated fuel. And then, a canister of which capacity is large to some degree should have been employed so far, in order to treat a fixed amount of evaporated fuel.

SUMMARY OF THE INVENTION

The present invention was made to solve the aforementioned problems. The object of the invention is to provide an evaporated fuel treatment device in which a canister can be improved in its capability, such that efficiency in treatment of evaporated fuel can be enhanced while the canister itself can be downsized.

In order to attain this object, according to a first aspect of the invention, there is provided an evaporated fuel treatment device comprising:

- a canister within which evaporated fuel generated in a fuel tank is adsorbed, the canister being connected to the fuel tank via an evaporation passage;
- a purge passage for connecting the canister and an inlet pipe of an internal combustion engine;
- an inlet air passage for introducing air to deliver to the purge passage the evaporated fuel desorbed from the canister, the inlet air passage being connected to the canister; and
- flow control means for controlling a flow of the air flowing through the inlet air passages the flow control means being disposed on the inlet air passage.

In the evaporated fuel treatment device according to the first aspect of the invention, a purge control valve conventionally provided on the purge passage is removed, and instead, the flow control means is provided on the inlet air passage. This means that the canister and the inlet pipe are connected to each other without any intervening member provided therebetween that causes, particularly, flow resistance. As a result, the canister is directly subject to a negative pressure generated on the side of the inlet pipe at the time of starting of the engine, and a great attraction force thus acts on the evaporated fuel adsorbed within the canister. Also, by restricting, by means of the flow control means, the flow of the air introduced into the canister in such a manner that easing of pressure applied to the canister is prevented, action of the negative pressure applied to the canister can be further increased. And consequently, the evaporated fuel adsorbed within the canister can be attracted more strongly to the side of the inlet pipe because of the negative pressure increased. In this manner, the amount of the evaporated fuel desorbed from the canister can be increased (in other words, the amount of the evaporated fuel remaining adsorbed within the canister can be reduced) compared to cases where an evaporated fuel treatment device having a conventional structure is employed. As a result, evaporated fuel in the amount corresponding to the amount of the evaporated fuel desorbed from the canister at this time can be subsequently introduced from the fuel tank to be re-adsorbed within the canister. That is to say, with the evaporated fuel treatment device according to the first aspect of the invention, the amount of evaporated fuel which can be adsorbed within the canister at a time (what is called an effective adsorption rate) can be increased compared to that with a conventional device, and performance of the canister can thus be enhanced. As a result, the evaporated fuel treatment device in its entirety can be improved in its capability of treating evaporated fuel. Furthermore, if the performance of the canister is enhanced, another advantage can be obtained in return; that is, the canister itself can be reduced in capacity, which is advantageous in view of space-saving.

The flow control means may be an orifice by which the inlet air passage is locally narrowed. Otherwise, it may be a valve having a simple structure and able to be opened and closed on the inlet air passage. However, once an air-fuel mixture composed of the evaporated fuel desorbed from the canister and the air introduced from the inlet air passage is delivered, via the purge passage, to the inlet pipe, an air-fuel ratio of the engine is influenced by the air-fuel mixture.

Accordingly, it may be necessary that the amount of the air introduced, via the inlet air passage, into the canister be properly controlled according to the condition of an engine load.

For this purpose, according to a second aspect of the invention, there is provided the evaporated fuel treatment device wherein the flow control means is constituted by a variable throttle mechanism capable of adjusting the flow of the air flowing through the inlet air passage.

In this structure, by adjusting, by means of the variable throttle mechanism, the amount of the air introduced into the canister as well as the action of the negative pressure applied to the canister, the amount of the evaporated fuel delivered to the inlet pipe can be properly adjusted.

Furthermore, according to a third aspect of the invention, there is provided the evaporated fuel treatment device wherein the variable throttle mechanism is constituted by a proportional control valve. This proportional control valve is an electromagnetic valve which can be opened and closed with timing electrically adjusted according to the condition of the engine load or the like, and it is the same one conventionally used as the purge control valve disposed on the purge passage. In other words, it can be said that, in the structure of the evaporated fuel treatment device of the intention, position of the proportional control valve conventionally used for flow control of the intake air to be delivered together with the evaporated fuel is changed from a conventional position, that is, on the purge passage, to on the inlet air passage. As a result of changing the position of the proportional control valve in this manner, desorption efficiency in the canister can be enhanced, and at the same time, flow control of the air-fuel mixture can be achieved as well for proper engine control.

In the aforementioned structure, however, a problem may arise when the negative pressure generated on the side of the inlet pipe is increased too much, for example, in cases where the operational status of the vehicle is unusual. More specifically, if a differential between an internal pressure of the canister and the atmospheric pressure becomes too large by the action of the negative pressure, the canister itself may be deformed or damaged because of such a large pressure differential. To prevent such deformation or damage, a certain restriction needs to be placed on the largeness of the negative pressure applied to the canister.

Then, according to a fourth aspect of the invention, there is provided the evaporated fuel treatment device further comprising a mechanism for blocking up the purge passage when the negative pressure applied to the canister becomes equal to or exceeds a predetermined value.

This mechanism may be constituted in such a manner that it is mechanically closed up when the pressure differential between the internal pressure of the canister and the atmospheric pressure becomes equal to or over a fixed value, this point in time being regarded as the time when the negative pressure becomes equal to or over the predetermined value. Otherwise, a pressure sensor for detecting the internal pressure of the canister may be provided separately, and in this case, the mechanism may be constituted such that it is controlled to be closed up when the internal pressure of the canister detected by the pressure sensor becomes equal to or below a fixed value, this point in time being regarded as the time when the negative pressure becomes equal to or over the predetermined value.

By constituting the evaporated fuel treatment device in the aforementioned manner, even if the negative pressure generated on the side of the inlet pipe becomes excessive, for example, in cases where any unusual situation arises during operation of the engine, the internal pressure of the canister can be kept equal to or below a fixed value, thereby protecting the canister from being deformed or damaged.

BRIEF DESCRIPTION OF THE DRAWINGS

The preferred embodiments of the invention will now be described in detail, with reference to the accompanying drawings, in which.

DESCRIPTION OF THE PREFERRED EMBODIMENTS

First of all, in this embodiment, an evaporated fuel treatment device is applied to a vehicle mounted with a gasoline engine.

Figure 1A:
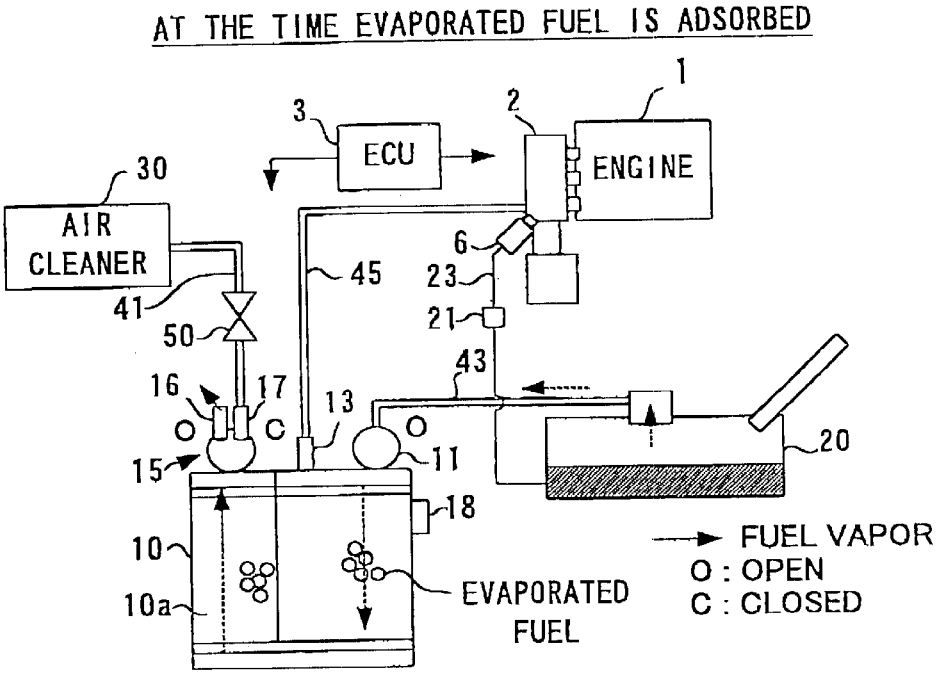
FIGS. 1A and 1B are schematic block diagrams showing the structure of an evaporated fuel treatment device according to an embodiment of the invention.
Figure 1B:
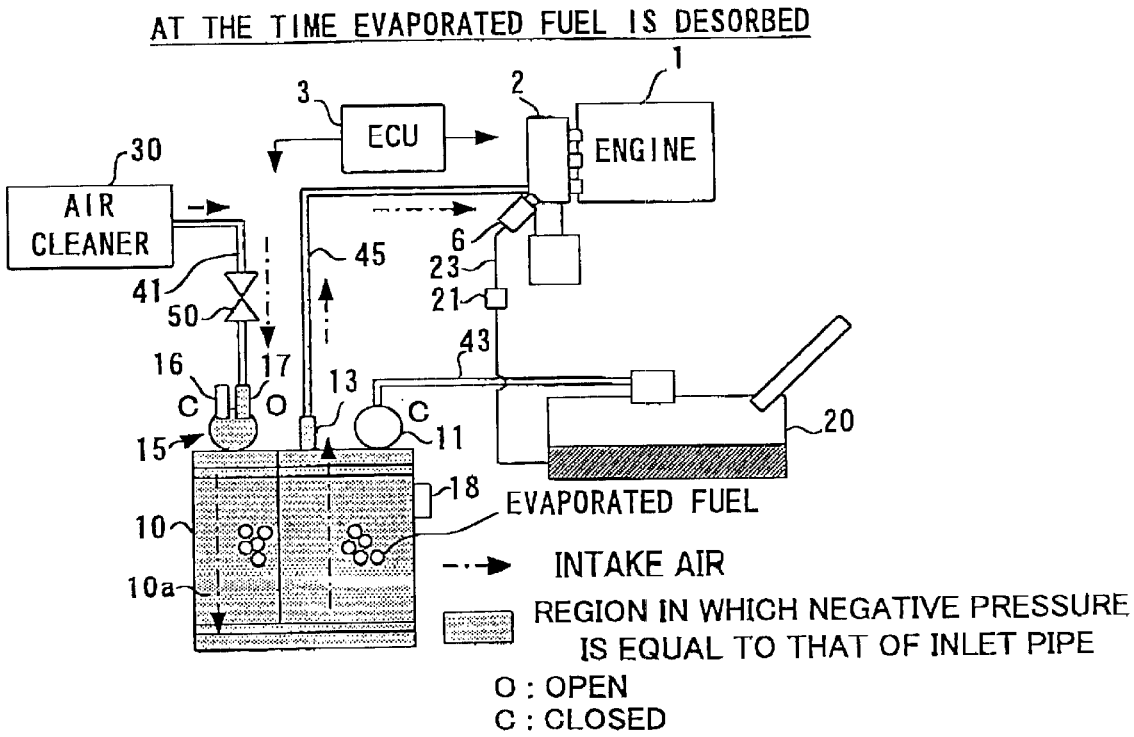

As shown in FIGS. 1A and 1B, the evaporated fuel treatment device of the invention includes a canister 10 within which evaporated fuel generated in a gasoline tank (fuel tank) 20 is temporarily adsorbed and a flow control valve 50, as flow control means, provided in the middle of an inlet air passage 41 to adjust a flow of air introduced from an air cleaner 30, via the inlet air passage 41, into the canister 10.

An evaporation passage 43 for introducing the evaporated fuel from the gasoline tank 20 into the canister 10 and a purge passage 45 for delivering to an inlet pipe 2 the evaporated fuel desorbed from the canister 10 are respectively connected to the canister 10. The connection between the evaporation passage 43 and the canister 10 is made via a tank internal pressure control valve 11 provided on the side of the canister 10. Also, the connection between the purge passage 45 and the canister 10 is made via a purge cut valve 13 provided on the side of the canister 10 as well.

The purge cut valve 13 blocks up the purge passage 45 when a negative pressure generated on the side of the inlet pipe 2 becomes large to such a degree that a differential between an internal pressure of the canister 10 and the atmospheric pressure is equal to or over a predetermined value. This is for preventing deformation of the canister 10 because of the pressure differential. The canister 10 is thus provided with a pressure sensor 18 for detecting the internal pressure of the canister 10 to compute the negative pressure. When the internal pressure detected by the pressure sensor 18 is below a predetermined value, the purge cut valve 13 is closed to shut off the negative pressure.

In addition to the evaporation passage 43 and the purge passage 45, the inlet air passage 41 is also connected to the canister 10 such that air can be introduced into the canister 10 through the inlet air passage 41. The connection between the inlet air passage 41 and the canister 10 is made via a twin valve 15 provided on the side of the canister 10. The twin valve 15 is composed of an exhaust valve 16 for outwardly emitting clean air purified by having adsorbed onto an adsorbent (for example, activated carbon or the like) 10*a* of the canister 10 the evaporated fuel introduced into the canister 10, and an inlet valve 17 opened for introducing air from the inlet air passage 41 into the canister 10 such that the evaporated fuel adsorbed onto the adsorbent 10*a* is desorbed therefrom. Each of the exhaust valve 16 and the inlet valve 17 has a simple structure to be opened in one direction, and when one is opened, the other is closed.

The flow control valve 50 provided on the inlet air passage 41 comprises a proportional control valve (also called a duty control solenoid valve) of which opening-and-closing timing can be electrically adjusted according to the condition of an engine load or the like. The proportional control valve is the same one as a purge control valve conventionally disposed on the purge passage, and its opening-and-closing timing is controlled in accordance with a control signal transmitted from an electronic control unit (ECU) 3, such that a flow of the air introduced into the canister 10 through the inlet air passage 41 (that is, a flow of the air-fuel mixture delivered to the inlet pipe 2) is adjusted for proper control of an engine 1.

As shown in FIG. 1A, the evaporated fuel generated in the gasoline tank 20 flows into the canister 10 via the evaporation passage 43 in a state where the tank internal pressure control valve 11 is opened. Then, the evaporated fuel is temporarily adsorbed onto the adsorbent 10*a* in the canister 10. At this time, clean air purified via the adsorbent 10*a* is emitted from the exhaust valve 16 of the twin valve 15 into the atmosphere.

As shown in FIG. 1B, when the engine 1 is started, the flow control valve 50 and the tank internal pressure control valve 11 are both closed. Consequently, the canister 10 is directly subject to the negative pressure generated on the side of the inlet pipe 2, and then, only the flow control valve 50 is opened such that air flows into the canister 10 via the inlet air passage 41. While the air passes through the canister 10, the evaporated fuel adsorbed onto the adsorbent 10*a* is desorbed, and the air-fuel mixture composed of the air and the evaporated fuel desorbed is delivered, via the purge passage 45, to the inlet pipe 2.

On the other hand, the gasoline tank 20 is connected to an injector 6, which is attached to the inlet pipe 2, via an injection passage 23 in the middle of which a fuel pump 21 is provided. In this structure, gasoline (liquid fuel) in the gasoline tank 20 is sucked by the fuel pump 21 to be supplied to the injector 6 through the injection passage 23, and then injected from the injector 6 into the inlet pipe 2.

The fuel for injection supplied to the inlet pipe 2 and the evaporated fuel contained in the air-fuel mixture are mixed together in a cylinder (not shown) of the engine 1 for combustion.

In a system of a vehicle having the evaporated fuel treatment device according to the embodiment, signals sent from various kinds of sensors, such as an intake air mass sensor, an inlet pipe internal pressure sensor, a throttle valve opening sensor, an oxygen sensor, and an engine revolutions sensor (all not shown), are read by the ECU 3. The operational status of the engine 1 is thus detected and predetermined control signals are outputted to each actuator, that is, the flow control valve 50, tank internal pressure control valve 11, purge cut valve 13, throttle valve (not shown), fuel pump 21, injector 6 and the like. More specifically, an appropriate timing for opening and closing the flow control valve 50 is computed by the ECU 3 based on an air-fuel ratio obtained from the output of the oxygen sensor or the like, an engine load computed using the output from each of the aforementioned sensors, and the like. Then, by controlling opening and closing operations of the flow control valve 50, the amount of the air introduced into the canister 10 and the amount of the air-fuel mixture delivered to the inlet pipe 2 are both adjusted.

Figure 2:
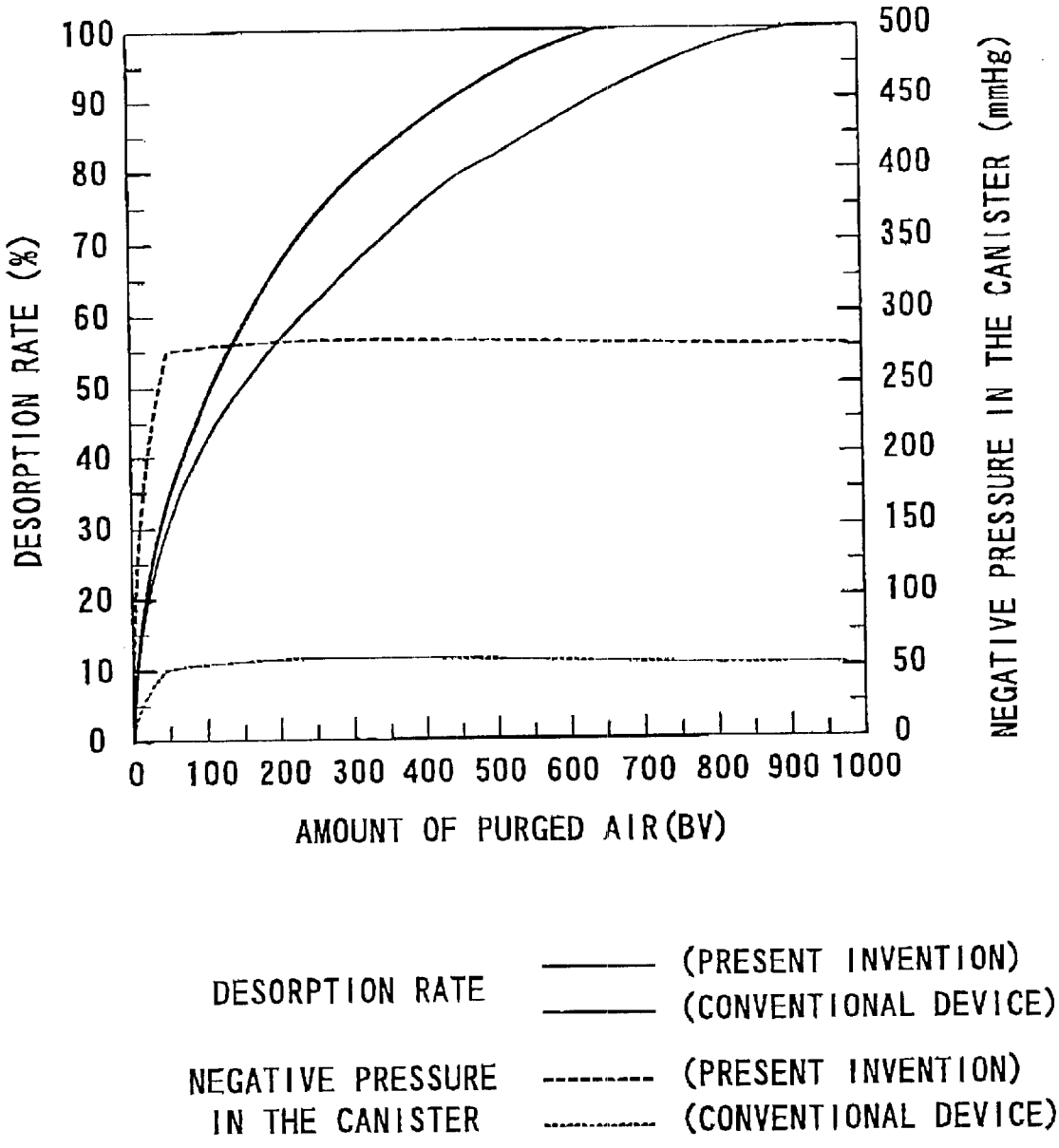
FIG. 2 is an explanatory view showing improvement in performance of a canister in the case where the evaporated fuel treatment device according to the embodiment is employed.
Figure 3A:
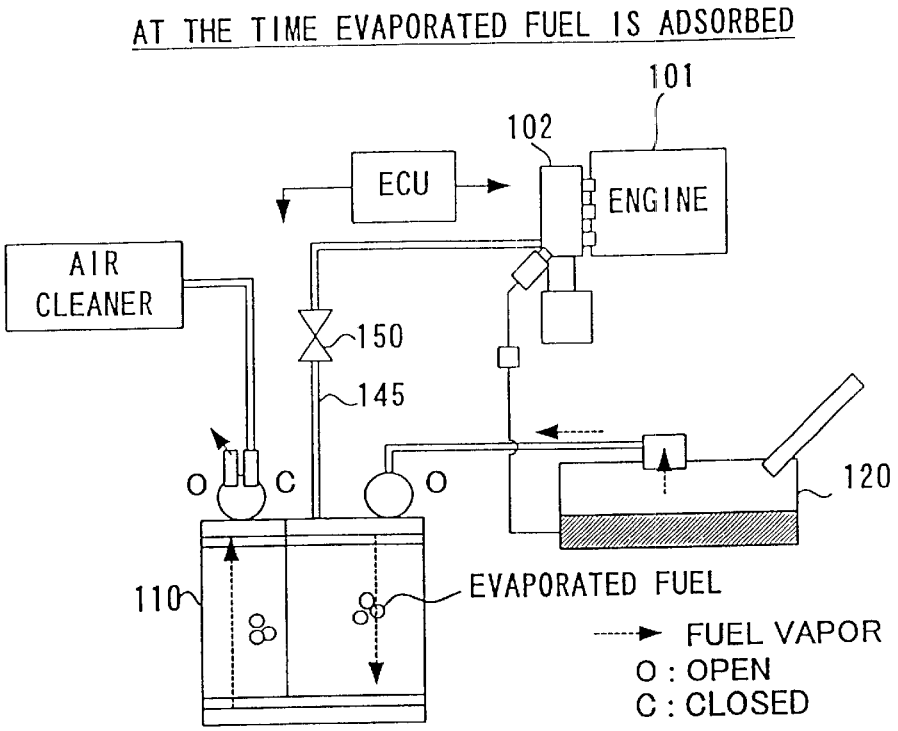
FIG. 3A Prior Art
FIGS. 3A and 3B are schematic block diagrams showing the structure of a conventional evaporated fuel treatment device.
Figure 3B:
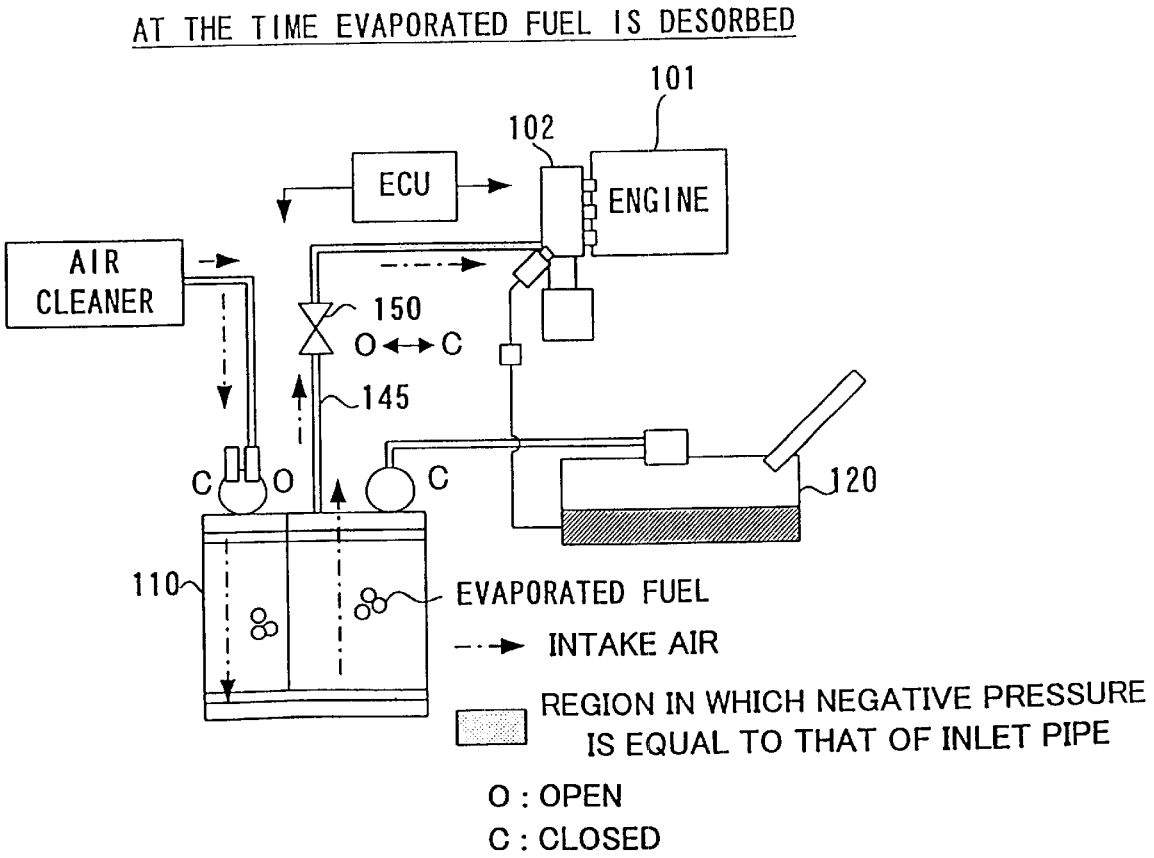
FIG. 3B Prior Art

Now, shown in FIG. 2 are experimental results for negative pressures in the canister and desorption rates of the evaporated fuel measured during activation of the engine. They are shown in FIG. 2, respectively, in comparison between the case where the evaporated fuel treatment device according to the embodiment, as shown in FIG. 1, is employed and the case where a conventional evaporated fuel treatment device is employed.

Here, the desorption rate (%) means a ratio of the evaporated fuel desorbed by the negative pressure generated on the side of the inlet pipe 2 to the entire evaporated fuel adsorbed onto the adsorbent 10*a* in the canister 10. In other words, the desorption rate represents a rate of evaporated fuel which can be re-adsorbed onto the adsorbent 10*a* subsequently to a desorption (what is called an effective adsorption rate).

An abscissa of FIG. 2 represents the amount of purged air, that is, the accumulated flow of the air introduced into the canister 10 via the inlet air passage 41 and the inlet valve 17 of the twin valve 15 at the time of starting of the engine 1, and then, delivered to the inlet pipe 2 via the purge passage 45. A unit of the amount of the purged air (BV) represents a ratio of the accumulated flow of the air introduced to the capacity of the canister 10 (an accumulated flow of the air/capacity of the canister 10: dimensionless amount). Also, the ordinates of FIG. 2 represent the desorption rate (%) of the evaporated fuel and the measured value of the negative pressure in the canister 10, respectively. The desorption rate and the measured value of the negative pressure (absolute value) are shown, respectively, by solid lines and by dotted lines. Furthermore, the results of the experiment using a device according to the embodiment are shown by thick lines and those of the experiment using a conventional device by thin lines.

As seen from FIG. 2, the negative pressure in the canister 10 is settled at a constant value once the engine is started, and such a constant value of the negative pressure in the structure according to the embodiment is over five times as great as that of the conventional structure, which means that the negative pressure generated on the side of the inlet pipe 2 is more influential in the case where the structure according to the embodiment is employed, compared to the case where the conventional structure is employed. Also, as a result, the desorption rate of the evaporated fuel is enhanced in the former case, compared to the latter case, with 10 percent or more of increasement.

As aforementioned, in the evaporated fuel treatment device according to the embodiment, the purge control valve conventionally disposed on the purge passage is removed, and the canister 10 is thus directly subject to the negative pressure generated on the side of the inlet pipe 2 at the time of starting of the engine. Consequently, a great attraction force acts on the evaporated fuel adsorbed within the canister 10. Also, by restricting the flow of the air introduced into the canister 10 by means of the flow control valve 50, the negative pressure applied to the canister 10 is further increased. As a result, as shown by the experimental results in FIG. 2, the amount of the evaporated fuel which can be desorbed from the canister 10 is increased as well, compared to cases where an evaporated fuel treatment device having the conventional structure is used. Then, after a desorption, evaporated fuel in the amount corresponding to that of the evaporated fuel desorbed from the canister 10 can be subsequently introduced from the gasoline tank 20 to be re-adsorbed within the canister 10. That is to say, a better performance of the canister 10 can be educed, and the evaporated fuel treatment device in its entirety can be improved in its capability of treating evaporated fuel. Furthermore, if the performance of the canister 10 is enhanced, another advantage can be obtained in return; that is, the canister 10 itself can be reduced in capacity: which is advantageous in view of space-saving.

Also, in the evaporated fuel treatment device according to the embodiment, a proportional control valve conventionally used for flow control of intake air to be delivered together with evaporated fuel is utilized, but a passage on which the proportional control valve is disposed is changed from the purge passage to the inlet air passage. In this way, desorption efficiency in the canister 10 can be enhanced, and at the same time, flow control of the air-fuel mixture can be achieved as well for proper engine control.

A preferred embodiment of the invention has been described above, however, the present invention is, of course, not restricted to such an embodiment and may be practiced or embodied in still other ways without departing from the subject matter thereof.

For example, in the embodiment described above, the evaporated fuel treatment device is applied to a vehicle mounted with a gasoline engine; however, the device of the invention is, of course, applicable to other types of vehicles as long as they are mounted with an engine for which volatile fuel, not restricted to gasoline, is utilized.

Also, in the embodiment described above, the evaporation passage 43 is provided as a passage for delivering to the canister 10 the evaporated fuel generated by volatilization from fuel previously stored in the gasoline tank 20; however, it can serve as well as a passage for delivering to the canister 10 evaporated fuel generated in refueling from a filler opening (not shown) into the fuel tank 20 (that is, as a refueling line so called). Otherwise, as such a refueling line, another passage may be provided in parallel with the evaporation passage 43.

Wherefore, we claim:

1. An evaporated fuel treatment device comprising:

a canister within which evaporated fuel generated in a fuel tank is adsorbed, the canister being connected to the fuel tank via an evaporation passage;

a purge passage for connecting the canister and an inlet pipe of an internal combustion engine;

an inlet air passage for introducing air to deliver, to the purge passage, the evaporated fuel desorbed from the canister;

flow control means for controlling a flow of the air flowing through the inlet air passage, and the flow control means being disposed on the inlet air passage; and a mechanism for blocking the purge passage when a negative pressure applied to the canister equals or exceeds a predetermined value.

2. The evaporated fuel treatment device according to claim 1, wherein the flow control means is a variable throttle mechanism capable of adjusting the flow of the air flowing through the inlet air passage.

3. The evaporated fuel treatment device according to claim 2, wherein the variable throttle mechanism is a proportional control valve.

* * * * *